252-103 AU 166 EX
5/15/79 XR 4,154,695

United States Patent [19]
McCrudden et al.

[11] 4,154,695
[45] May 15, 1979

[54] BLEACHING COMPOSITION

[75] Inventors: Joseph E. McCrudden, Warrington, England; David S. Horne, Irvine, Scotland; Alan Prodgers, Manchester, England; Alan E. Comyns, Chester, England; Alan Smith, Tarvin, England; Peter J. Russell, St. Helens, England; Robert E. Talbot, Burtonwood, England

[73] Assignee: Interox Chemicals Limited, London, England

[21] Appl. No.: 683,653

[22] Filed: May 6, 1976

[30] Foreign Application Priority Data

| | | | |
|---|---|---|---|
| May 13, 1975 | [GB] | United Kingdom | 20033/75 |
| Nov. 18, 1975 | [GB] | United Kingdom | 47387/75 |
| Nov. 18, 1975 | [GB] | United Kingdom | 47389/75 |
| Nov. 18, 1975 | [GB] | United Kingdom | 47390/75 |

[51] Int. Cl.[2] ..... C11D 7/54
[52] U.S. Cl. ..... 252/99; 252/94; 252/102; 252/103; 252/DIG. 1; 252/DIG. 7; 8/111; 260/502 R; 260/343.3 R; 568/566
[58] Field of Search ..... 252/186, 94, 99, 102, 252/DIG. 1, DIG. 7, 103; 260/502, 610 R; 8/111

[56] References Cited

U.S. PATENT DOCUMENTS 4,006,092 2/1977 Jones ..... 252/99 X

*Primary Examiner*—Mayer Weinblatt
*Attorney, Agent, or Firm*—Larson, Taylor and Hinds

[57] ABSTRACT

The invention provides bleaching and detergent compositions containing a diacyl peroxide of general formula $ROOR^1$ in which R represents a phthaloyl radical and $R^1$ a radical such that $ROOR^1$, ROOR and $R^1OOR^1$ are all soluble in mildly alkaline aqueous solutions. The compositions, optionally containing a persalt such as sodium perborate, preferably in a mole ratio of one mole per mole of diacyl peroxide, are particularly suitable for washing or bleaching at a temperature of from 30°-60° C. The invention also provides diacyl peroxide compositions desensitized to impact or abrasion by intimate contact with a diluent, e.g. magnesium sulphate, lauric acid or sodium tripolyphosphate and protected against destructive interaction with other components of the bleaching on detergent composition during storage. Preferred diacyl peroxides include diphthaloyl peroxide, especially for colored fabrics.

18 Claims, No Drawings

BLEACHING COMPOSITION

The present invention relates to bleaching compositions, or detergent compositions containing a bleaching agent, and more particularly to the provision of compositions having bleaching activity at low washing temperatures.

At present, conventional detergent compositions contain sodium perborate tetrahydrate as the bleaching agent. Also, there is a tendency towards washing at a lower temperature on account of the increasing use of synthetic fibres and special finishes. However, perborate is relatively ineffective at temperatures in the range of 30°–50° C. and consequently, a replacement for it or activation of it is becoming desirable, particularly for the short time cycles normally used in domestic washing machines.

Various activators have been proposed, but many of them for example tetracetyl glycoluril and tetra acetyl ethylene diamine, generate as active bleaching species, peroxyacetic acid, which has a characteristic pungent odour that is recognisable by users in the home and is difficult to mask. Furthermore such activators are nitrogen-containing and therefore exacerbate eutrophication problems. Consequently, it is desirable to provide a nitrogen - free activator that preferably does not generate peroxyacetic acid.

One class of active oxygen - containing compounds, comprises diacyl peroxides. Certain members of the class were disclosed many years ago in Belgian Pat. No. 603,768 by Thomas Hedley & Co., as being suitable bleaching agents, the suitability being determined by a solubility test which measured the amount of peroxyacid (the active bleaching species) formed by diacyl peroxide in an aqueous detergent solution at 50° C. after 5 minutes. The test can produce values from 0 to 17.5 values of at least 2.0 indicating satisfactory bleaching agents. Most of the satisfactory bleaching agents were asymmetric peroxides containing a benzoyl moiety and an aliphatic moiety, eg benzoyl succinyl peroxide, which gave one of the best test values. Hedley disclosed that the value achieved by a diacyl peroxide in their test correlated with the bleaching ability of the diacyl peroxide. However, we have found that when asymmetric diacyl peroxides like benzoyl succinyl peroxide are contacted with a mildly alkaline aqueous solution, there is a tendency for substantially insoluble dibenzoyl peroxide to be formed. Consequently there is a great risk of detrimental side effects such as localised damage to fibre, to finish or to dyestuff on account of insoluble bleaching agent being entrained in fabric to be washed. Secondly, the active bleaching species produced from dibenzoyl peroxide is peroxybenzoic acid, which causes dye damage at active oxygen concentrations commonly employed in washing and bleaching solutions. Thus, in practice, Hedley do not distinguish adequately between an acceptable and an unacceptable bleaching agent. Hedley did also disclose one compound 4,4'-dicarboxydibenzoyl peroxide, which does not form dibenzoyl peroxide, but it had a value in their test of only 3.8, indicating that less than 22% of the peroxyacid had been produced. They apparently did not consider it sufficiently interesting for them to determine its colour removing properties.

In the later British Pat. No. 1,293,063, Procter & Gamble proposed an improved diacyl peroxide, benzoyl glutaryl peroxide. However, like its analogues disclosed by Hedley, it is capable of producing dibenzoyl peroxide and peroxybenzoic acid, and consequently in that respect is no more suitable than, e.g., benzoyl succinyl peroxide.

We have discovered that the above mentioned disadvantages can be ameliorated by employing as bleaching agent a diacyl peroxide of general formula $ROOR^1$ that is itself relatively water soluble and which does not produce any relatively water-insoluble diacyl peroxides ROOR and $R^1OOR^1$ when contacted with water.

Consequently, according to the present invention there is provided a bleaching or detergent composition containing as bleaching agent a diacyl peroxide of general formula $ROOR^1$ wherein R represents a phthaloyl radical and $R^1$ represents an acyl radical, such that ROOR, $ROOR^1$ and $R^1OOR^1$ are soluble in mildly alkaline aqueous conditions.

According to a second aspect of the present invention there is provided a process for bleaching textile material which comprises treating such material with an aqueous solution prepared by dissolution of a diacyl peroxide of the general formula $ROOR^1$ wherein R represents a phthaloyl radical and $R^1$ represents an acyl radical, such that ROOR, $ROOR^1$ and $R^1OOR^1$ are soluble in mildly alkaline aqueous conditions.

By the term "phthaloyl radical" is meant a radical that is capable of generating in aqueous solution a peroxyacid of general formula:

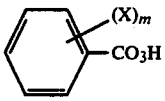

(1)

wherein X represents a carboxy or peroxycarboxy acid substituent and m $\geqq 1$, the benzene nucleus optionally being further substituted by a lower alkyl, nitro or chloro group. It is to be understood that the only substituents which can be employed are those which in practice do not render $ROOR^1$ ROOR or $R^1OOR^1$ insoluble in mildly alkaline aqueous conditions.

Whether a diacyl peroxide is soluble in mildly alkaline aqueous conditions can be determined by the following test described by Hedley:

2.5 g of tetrasodium pyrophosphate and 0.5 g of sodium dodecyl benzene sulphonate are dissolved in 1 liter of distilled water, and allowed to attain equilibrium at 50° C. in a thermostatically controlled bath.

The solution is poured into a 2 liter three way flask equipped with a stirrer rotating at 600 rev/min. A certain amount of diacyl peroxide in fine powder form equivalent to 35 ppm of available oxygen is added with constant stirring, to the solution and mixing is continued for 5 min. Two 100 $cm^3$ aliquots of the solution are withdrawn and pipetted into conical flasks each containing 0.4 g. of potassium iodide and 15 $cm^3$ of glacial acetic acid. The free iodine is titrated with a 0.025 N sodium thiosulphate solution using starch as the indicator. The average amount of 0.025 N sodium thiosulphate which is equivalent to the liberated iodine gives the strength of the diacyl peroxide.

For the purpose of the instant specification, a diacyl peroxide is considered to be soluble only if it achieves a value in the test of at least 7.5, using standardised equipment in which 4-methoxybenzoyl succinoyl peroxide achieves a value of 8.1 and benzoyl succinyl peroxide a value of 12.8. We prefer diacyl peroxides to have a value of 10 or greater. We have found that diphthaloyl peroxide has a value in the test very similar to that of benzoyl succinyl peroxide i.e. within about 0.5.

Upon dissolution of diacyl peroxides under mildly alkaline aqueous conditions, hydrolysis occurs, forming peroxyacid anions, which are or produce active bleaching species. Competitive or consequential reactions can result in the formation of diacyl peroxides of general formula ROOR and $R^1OOR^1$. Consequently, unless any newly formed diacyl peroxides are also soluble, active oxygen is removed from aqueous solution, and in general this leads to less efficient use of active oxygen, and to spot bleaching and similar problems.

Preferably R represents a radical such that there is generated in aqueous solution a peroxyacid of general formula (2):

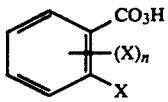

(2)

wherein X represents a carboxy or peroxycarboxy group and $n \geqq O$, or anions thereof the benzene nucleus in R optionally being further substituted by a lower alkyl, nitro or chloro group. Such compounds have a carboxy group ortho to a peroxycarboxy group, and in consequence have three advantages. First, the presence of the carboxy group appears to reduce interaction between the peroxyacid and the fabric, thereby reducing fibre damage. Secondly, the products can be produced selectively more easily since the diacyl peroxide can be formed from an internal anhydride precursor. This advantage is particularly applicable when n is O or when X represents solely carboxy groups or when n is 2 and the two additional X groups are ortho to each other, one of X representing a carboxy group and the other of X a peroxy-carboxy group. Thirdly, and importantly, dye damage is reduced as a result of the carboxy group being ortho to the or each peroxycarboxy group. In some especially preferred embodiments n = O ie., R represents a 2 - carboxy - benzoyl radical. This radical is especially convenient because it can be produced simply and selectively from a readily available and cheap raw material, phthalic anhydride, and of the compounds disclosed herein, is comparatively safe to employ on coloured fabrics and on fabrics having special finishes. Fluidity determinations indicate that such a diacyl peroxide depolymerises cellulose no more than the conventional bleach sodium perborate, despite being active at lower temperatures, and washing tests indicate that the brightening effect of various distyryl-diphenyl or triazinyl stilbene derivatives is not significantly altered.

In some embodiments the phthaloyl radical R contains at least 3 carboxy or peroxy-carboxy groups, ie $m \geqq 2$ in general formula (1) and in some cases $n \geqq 1$ in general formula (2). When diacyl peroxides are used in aqueous solution the resultant multi-carboxy acid product formed when the peroxyacid has given up its active oxygen demonstrates improved builder properties in comparison with the product which is produced from mono-peroxyphthalic acid and which contains only two carboxy groups. This advantage becomes more marked as m becomes 4 or 5.

It will be observed that in theory m in general formula (1) can have a value between 1 and 5. However, in practice, the presence of an increasingly large number of peroxyacid substituents lead to an increasingly unstable molecule. In practice, therefore, it is advisable that care be taken in the manufacture and handling of diacyl peroxides which generate such peroxyacids, particularly if precautions to guard against impact and friction have not been taken fully.

When m is greater than 1, m is preferably 2 or 3. When m in the formula is 2 and X is carboxy, suitable peroxyacids generated comprise monoperoxytrimellitic acid (2 isomers), and monoperoxyhemimellitic acid (2 isomers) but when X is peroxycarboxy then the peroxyacids are triperoxytrimellitic acid, and triperoxyhemimellitic acid. When m in general formula (1) is 3, suitable peroxyacids include the peroxyacid derivatives of pyromellitic and prehnitic acids, including 1,3 or 1,4 - diperoxypyromellitic acid, 1,2,4,5-tetraperoxypyromellitic acid, 1,3- and 1,4-diperoxymellophanic acid and 1,2,3,4-tetraperoxymellophanic acid. Such peroxyacids can be substituted in the ring by a nitro, chloro or a lower alkyl, e.g., methyl group. In general, peroxyacids containing at least two peroxy groups tend to be more active bleaching agents than monoperoxyphthalic acids, except where a carboxy group is ortho to each peroxycarboxy groups. Such peroxyacids are thus particularly suited to bleaching white fabirc, such as white cotton or linen.

The peroxyacids are formed in solution by a process of hydrolysis or perhydrolysis of the diacyl peroxide, the carboxy and other peroxycarboxy substituents in R and $R^1$ retaining their relative positions around the benzene nucleus when the peroxyacids anions are generated.

Suitably the $R^1$ radical can be an aromatic acylradical substituted by solubilising groups such as carboxylic acid groups e.g. a phthaloyl radical as described hereinbefore, or soluble aliphatic acyl radicals such as succinyl or glutaryl radicals. Suitably the peroxide can be symmetrical as for example diphthaloyl peroxide or asymmetrical for example phthaloyl glutaryl peroxide. Other suitable peroxides include 2,2',5,5'-tetracarboxy 4,4'-diperoxycarboxydibenzoyl peroxide, 2,2',4,4'-tetracarboxy 5,5'-diperoxycarboxydibenzoyl peroxide, 2,2',4,4'-tetraperoxycarboxydibenzoyl peroxide and 2,3,4-triperoxycarboxy-2'-carboxydibenzoyl peroxide.

It will be recognised that where the diacyl peroxides are asymmetric both symmetric peroxides, ROOR and $R^1OOR^1$ derived therefrom are soluble in aqueous mildly alkaline solutions, as hereinbefore described.

It will be recognised further that some of the diacyl peroxides described herein contain at least one moiety having carboxylic or peroxycarboxylic groups meta or para to each other. In consequence, to at least some extent, unless specific precautions are taken, production of the diacyl peroxides can result in formation of polymeric acyl peroxides, i.e. compounds containing at least two acyl peroxide linkages, especially if the moiety intentionally contains more than one peroxide group. Since such polymeric acyl peroxides also form the requisite peroxyacids in aqueous solution, they are included within the present invention. Such diacyl peroxides are capable of rapidly hydrolysing in mildly alkaline solution, i.e. within the general pH limits of 7 to 11 which are commonly employed at present. Preferably bleaching and washing compositions containing the diacyl peroxides are formulated to give a solution pH of from about 8.5 to 9.5.

It is not essential for the diacyl peroxide to provide all the active oxygen content of the bleaching or detergent composition. Solid compositions can contain persalts, i.e. true peroxo compounds, e.g. sodium perborate monohydrate or tetrahydrate, or hydrogen peroxide addition products e.g. so called sodium percarbonate, which generate in solution perhydroxyl anions. It is believed that the perhydroxyl anions interact with acyl peroxide linkages to generate peroxyacid anions. Desirably the persalt is present in an amount within the range of 5:1 to 1:5 molecules of persalt per acyl peroxide linkage, preferably approximately 1:1, and conveniently not less than 1:5. It will be recognised that a diacyl peroxide contains only one acyl peroxide linkage, whereas polymeric acyl peroxides contain a plurality of such acyl peroxide linkages. Thus, the acyl peroxides described herein can act as bleaching agents in their own right, or if desired can be employed as a combined bleach/bleach activator.

A disadvantage of some diacyl peroxides is their tendency to detonate or explode when subjected to shock or abrasion, i.e. they suffer from impact and friction sensitivity. They can be also unstable when exposed to elevated temperatures. In consequence, diacyl peroxides are difficult to use as domestic bleaching agents or for incorporation in heavy duty detergent compositions, because transportation and processing inevitably results in the bleaching agent being subjected to shock or abrasion. We have found that the problem of impact and friction sensitivity can be reduced by intimately contacting the diacyl peroxide with a desensitising amount of solid desensitising diluent.

By the term "densensitising diluent" is meant an organic or inorganic compound or mixture which, in initmate contact with the diacyl peroxide, reduces the impact and friction sensitivity of the latter.

By the term "densensitising amount" is meant an amount which renders the diacyl peroxide composition non-hazardous i.e. no longer impact or friction senstitive. In a standard drop weight test 30 mg. of material, which has been sieved to finer than 710 microns, is placed on an anvil in the apparatus. The anvil is centred and the sample tamped lightly by an impact of 5 Kg-cm. A weight is then dropped several times from a given height, each time onto a fresh sample, and its effect observed. A positive result can range from being merely a discoloured product, through emission of a cloud of smoke, to the extreme case of an explosion. The tests are carried out at a series of heights. A higher proportion of positive results occur when a greater force is employed. The figure usually quoted is the median point E50, the point at which 50% of the results at a given force are positive. Compositions having a median point of at least 200 Kg-cm are considered to be non-hazardous but to provide a greater margin of safety, compositions preferably have a median point of at least 300 Kg-cm.

Preferably the solid desensitising diluent is a detergent builder, or processing additive and optionally other components of detergent compositions than surfactants. By incorporating such compounds intimately the diacyl peroxide can effectively be desensitised, but the overall cost of the resultant bleaching or detergent composition is not markedly increased because detergent builders and/or processing aids are usually incorporated.

Consequently, according to a further aspect of the present invention there is provided a composition, suitable for mixing with a surfactant and optionally other detergent components to form a heavy duty detergent composition, comprising a diacyl peroxide of general formula $ROOR^1$ wherein R represents a phthaloyl radical and $R^1$ represents an acyl radical, such that ROOR, $ROOR^1$ and $R^1OOR^1$ are soluble in mildly alkaline aqueous conditions, in intimate contact with a desensitising amount of a detergent builder, or processing additive and optionally other components of detergent compositions apart from surfactants.

It is to be understood that the minimum desensitising amount is dependent upon several factors including the homogeneity of the composition formed from the diacyl peroxide and diluent, and the identity of each of the diacyl peroxide and diluent. The amounts required in any particular embodiment, though, can be easily found by simple trial. In any event, it is preferable to exceed the minimum desensitising amount, advantageously providing sufficient to raise the first occurrance of detonation instead of the medion point E50, least 200 kg. cm, and more desirably to at least 300 kg. cm. In general the weight ratio of diacyl peroxide to diluent employed is selected within the range of 1:0.5 to 1:10 and frequently within the range of 1:1 to 1:10.

We have found that certain classes of diluents are substantially unreactive with the diacyl peroxides described herein, viz contacting them with the diacyl peroxides does not lead to a marked acceleration in the natural rate of decomposition of the diacyl peroxide. If two or more diluents are used it is much preferred to deploy them in such a way that substantially only unreactive diluent is brought into contact with the diacyl peroxide. Examples of such unreactive diluents are hydrocarbons having melting points in excess of 30° C., aliphatic fatty and aromatic acids and esters thereof, cellulosic materials, protein and starch materials, boric acid, aluminosilicates, clays and alkali and alkaline earth metal salts of halogen-free acids having a first dissociation constant of at least $1 \times 10^{-3}$.

Suitable hydrocarbons can be aliphatic or aromatic microcrystalline waxes, for example obtained from distillation of crude oils, or polymers such as polyethylene or polypropylene, preferably having melting points in the range of 30° C. to 60° C. In order to improve dispersion in use, the hydrocarbons can contain a dispersant e.g. 1% to 10% based on the weight of hydrocarbon, of a sulphonated surfactant in which any free acid has been neutralised.

Although any aliphatic fatty acid may suitably be used, for practical purposes the acid normally contains from 10 to 26 carbon atoms, including stearic acid, myristic acid and palmitic acid. Preferably the aliphatic acid has a melting point of about 40° C. e.g. lauric acid, so that it can be conveniently melted and used thereby to coat or bind together particles of the diacyl peroxide. Commercially available mixtures of fatty acids such as coconut fatty acids which contain a high proportion of lauric acid may conveniently be employed. Suitably the aromatic acid may be dibasic, such as phthalic, isophthalic or terephthalic acid. Other suitable aromatic acids include benzoic acid, toluic acid and mellitic acid. The esters are preferably short chain aliphatic e.g. n-butyl iso-butyl or tertiary butyl hexyl or pentyl esters, or aromatic, e.g. benzoyl or phenyl.

Included within the term cellulosic materials are cellulose itself, and derivatives of it such as carboxymethylcellulose and methyl- or hydroxymethyl-cellulose.

Included within the terms protein and starch materials are dextrin, gelatin and starch itself.

Where the diacyl peroxide is contacted with the organic diluent from solution, eg, in methanol, the composition is preferably dried, suitably by passage of air to remove traces of the solvent.

Salts of acids having pKa < 3 include nitrates, polyphosphates, pyrophosphates and sulphates. Suitable salts include potassium, lithium, sodium, and magnesium sulphate; sodium and magnesium nitrate, pyrophosphate and tri-polyphosphate. Preferred diluent salts are sodium and magnesium sulphate and sodium tripolyphosphate. Bisulphates, although usable are less preferred. Use of a high proportion of lower hydrate of magnesium sulphate can be desirable because it is able to remove free water from the bleaching composition. Aluminosilicates and clays, preferably those which can readily absorb and retain water, can be employed. It will be recognised that sodium tripolyphosphate is an example of a detergent builder and sodium sulphate is an example of a processing additive.

There are other diluents which although suitable to reduce impact sensitivity react at least to some extent with diacyl peroxides. The effect is apparently less noticeable for diluents having melting points at about 40° C. or preferably higher. Such diluents include aliphatic fatty acid alkaolamides, fatty alcohol polyglycol ethers, alkaryl polyglycol ethers, ethylene oxide/propylene oxide polymers, polyethylene glycol and fatty acid esters and amides thereof and glycerol and sorbitol esters and amides. Such compounds tend to include a high proportion of hydroxyl, ether or ester-groups. Preferably they are separated from the diacyl peroxide by a layer of unreactive diluent. Suitably, in the polyethylene glycol fatty acid esters, fatty acid alkanolamides, glycerol esters and amides, and moiety comprising the fatty acid or amide derivative thereof preferably contains between 12 to 26 carbon atoms and can conveniently be lauric myristic, palmitic or stearic acids or mixtures obtained commercially from natural sources, such as tallow fatty acids and coconut fatty acids. Desirably the polyethylene glycol moiety has a molecular weight of from 250 to 2000, preferably from 300 to 1200. Desirably the alkanolamide moiety is a short chain aliphatic alcohol moiety.

Amongst other inorganic compounds which can be considered are aluninum sulphate, alkali and alkaline earth metal silicates, especially sodium and magnesium silicate, sesquicarbonates and mixed sulphatocarbonates in a mole ratio of sulphate to carbonate of from 1:0.3 to 1:3, preferably separated from the diacyl peroxide by a layer of a non-reactive diluent.

The composition of diacyl peroxide and diluent can be prepared by conventional routes for coating or binding together particles of diacyl peroxides with the diluent. Thus, for example the particles may be coated using a fluidised bed, a rotating pan or a spheroniser, employing where appropriate, molten diluent or a solution of diluent in water or a compatible organic solvent.

Conveniently, intimate association of diluent and diacyl peroxide can also be achieved in some embodiments by co-precipitation. A decrease in impact sensitivity can be obtained by merely admixing particulate diluent with particulate diacyl peroxide, but in general, due to difficulties in obtaining and maintaining an adequate and appropriately even distribution, rather more diluent is required when merely mixing than when the diluent is bound to the diacyl peroxide, e.g. by using spheronising or granulation techniques.

It will be understood that the diacyl peroxides can be desensitised by a plurality of the diluents, either mixed together or applied separately as is appropriate. Thus, for example, particulate diacyl peroxide may be spheronised in a first stage with an aliphatic fatty acid such as lauric acid, and then coated in a second stage with one of the inorganic diluents such as sodium or magnesium sulphate or with one of the organic diluents such as a further amount of lauric acid or one of the other diluents such as dextrin. It is to be emphasised that the present invention encompasses embodiments in which the total amount of diluent is distributed as a first amount to bind together particles of the diacyl peroxide and form granules and a second amount (which may be the same diluent or another) which coats the surface of the granules.

Preferably the diacyl peroxides are never permitted to dry out before they are desensitised, so that they can always be handled relatively safely. Thus, where convenient, substantially water-insoluble diluent can be present during formation or precipitation of the diacyl peroxide and water-soluble diluent can be added to damp filter cake, preferably after washing the cake.

In general, preparation of the peroxides tends also to produce a small proportion of peroxyacids. These tend to be more sensitive to temperature because they have lower molecular weights than their corresponding diacyl peroxides. Preferably the content of such peroxyacids is lowered, either for example, by controlling the manufacturing process to minimise their production or by subsequent washing with water or organic solvent.

During storage in the presence of alkaline compounds, such as the alkaline materials and surfactants present in normal detergent compositions, there is a tendency for the diacyl peroxide to lose active oxygen. We have found that by coating the diacyl peroxide with various of the diluents described hereinbefore the tendency can be reduced, in particular using solid hydrocarbons, aliphatic fatty acids, aliphatic fatty alcohols, ethoxylated alcohols, polyvinyl alcohol, polymethyl methacrylate, dextrin, starch, gelatin, carboxymethylmethacrylate and sodium sulphate. Normally the amount of coating is selected within the range of 3% to 35% based on the weight of the coated product. By coating the diacyl peroxide, and if desired the persalt, destructive interaction of the active-oxygen containing compounds with other components of detergent or bleaching compositions such as enzymes, optical brighteners, colouring agents or perfumes during storage can be minimised.

One convenient method of providing a desensitised composition, suitable for incorporation in a detergent composition and substantially isolated from alkaline surfactants, is to shape a mixture of particulate diacyl peroxide with a particulate inorganic diluent, such as sodium sulphate or tripolyphosphate, or magnesium sulphate into tablets or extrudates. Such tablets or extrudates, by themselves, effectively reduce the surface of diacyl peroxide presented to the alkaline surfactants, and thus alleviate the problem of loss of active oxygen during storage. The problem can be further alleviated by providing an outer layer around the tablets or extrudates comprising at least one of the coating compounds described hereinbefore, generally in an amount of up to 20% by weight. Alternatively, any suitable organic compound can be formed into a flexible sachet, within which a diluent/diacyl peroxide mixture can be placed. Advantageously the tablet, extrudate or sachet can contain a persalt such as sodium perborate or sodium percarbonate, in a mole ratio of diacyl peroxide to persalt of from 5:1 to 1:5, desirably from 2:1 to 1:2, and often approximately 1:1.

The proportion of the active oxygen containing compounds in the detergent composition is preferably selected so that the total active oxygen content falls within the range of 0.1% to 4% by weight.

The diacyl peroxide is conveniently present in solid form when incorporated in detergent or bleaching compositions. Thus, if the diacyl peroxide is naturally liquid at the temperatures of storage of such compositions, it may be rendered in solid form by encapsulation or by absorption into a solid substrate.

Generally speaking, bleaching or detergent compositions according to the present invention can contain components other than the diacyl peroxide and the inorganic percompound. Conventionally components are selected from detergent builders, diluent salts, surfactants and minor proportions of colours, perfumes, bleach stabilisers, optical brighteners, soil antiredeposition agents, enzymes, dedusting agents, tarnish inhibitors and abrasives.

Suitable builder salts can be either organic, for example aminopolycarboxylates, organic polyphosphates, sodium citrate or sodium gluconate, or inorganic, for example, alkali metal carbonates, silicates, phosphates, polyphosphates or aluminosilicates. Typically, builders are present in proportions of from 1% to 90% by weight. Such compounds alter the pH of detergent/-bleaching solutions. Preferably sufficient builder salt is used to adjust the pH of the solution to from pH 7 to 11, more preferably from pH 8 to 11.

A typical processing aid is sodium sulphate which is conveniently incorporated in detergent/bleaching compositions in a amount of from 1 to 40% by weight.

Where some builder salt or processing aid has been used to desensitise the diacyl peroxide the amount so used is included in the total amount of builder salt or processing aid present in the composition.

The surfactants may conventionally be water-soluble anionic, non-ionic, ampholytic or zwitterionic surface active agents. Suitable surfactants are often selected from fatty acids and their alkali metal salts, alkyl sulphonates, alkylated aryl sulphonates, especially linear alkyl benzene sulphonates, sulphated aliphatic olefins, sulfated condensation products of aliphatic amides and quaternary ammonium compounds. The surfactants are normally present in the detergent composition in amounts of from 1% to 90% by weight, often in a weight ratio to the builder salts of from 2:1 to 1:10. It is believed that in aqueous alkaline media organic peroxyacids are formed from the diacyl peroxide. Consequently, the bleaching composition can include any compound or compounds which enhance the bleaching or washing activity of organic peroxyacids, such as ketones and aldehydes as described in U.S. Pat. No. 3,822,114 or certain quaternary ammonium salts as described in British Pat. No. 1,378,671, both patents to Proctor & Gamble.

Bleaching processes according to the present invention may be carried out at a temperature from about 25° C. up to the boiling point of the washing solution, and compositions according to the present invention are well suited to a process at which washing or bleaching is carried out at a temperature from about 25° to 60° C. Alternatively the washing and bleaching processes may be effected by heating up a cold washing solution.

In general, it is desirable for washing or bleaching solutions for use in the home to contain at least 1 part per million available oxygen (Av. Ox.) preferably at least 5 parts per million Av. Ox. Household washing solutions prepared by dissolution of detergent compositions in general provide no more than about 200 ppm. Av. Ox., frequently no more than 100 ppm Av. Ox. and in many cases in the range of 25 to 100 ppm Av. Ox. Especially when the peroxyacid generated contains a plurality of peroxyacid groups a significant removal of stains from cloth can be achieved by using solutions containing from 5 to 50 ppm Av. Ox.

In general, the rate of removal of stains is enhanced by employing a higher temperature and by higher Av. Ox. concentrations. By virtue of the rapid rate at which the diacyl peroxides dissolves in aqueous detergent solutions, the contact period between solution and fabric can conveniently be as short as 5 minutes. Longer periods of for example, up to 1 hour tend to provide greater soil removal.

Whereas inorganic peroxides such as sodium perborate by themselves or when activated by nitrogen-containing activators significantly interfere with removal of, e.g., blood by enzymes under cold soaking conditions, especially in relatively short soaking periods of up to about four hours, we have found that at least some of the diacyl peroxides disclosed herein, in particular diacyl peroxides containing one peroxy group such as 2,2'-dicarboxydibenzoyl peroxide interfere to a much lesser extent.

Many detergent compositions are formulated so as to remove some stains from fabrics treated and to prevent the redeposition of such stains or dye transfer onto the fabric. Consequently, it is extremely desirable for the bleaching agent to be able to bleach stains in solution, and in this respect the diacyl peroxides as described herein are particularly useful on account of their comparatively high solubility in aqueous alkaline solutions, thereby enabling peroxyacidic species to be formed in solution at a rapid rate.

The diacyl peroxides can be prepared by reacting an appropriate precursor or precursors with an inorganic peroxide such as hydrogen peroxide or sodium peroxide. Although certain other classes of compound such as acids can sometimes be employed as precursors, it is normally more convenient to employ the appropriate acyl chloride or anhydride. Thus, symmetrical diacyl peroxides can be formed by reacting two moles of the precursor with one mole of inorganic peroxide, e.g. reaction between 2 moles of the half acyl chloride of isophthalic acid and sodium peroxide forms 3,3'-dicarboxydibenzoyl peroxide. It will be recognised that where the acyl chloride precursor is formed by partial hydrolysis of a di- or multi-acyl chloride, as is the case for formation of the half acyl chloride of isophthalic acid unless an additional and costly separation step is employed, the resultant product will be a mixture containing fully hydroysed, partly hydrolysed and unhydrolysed product. Assymetrical diacyl peroxides can conveniently be prepared by first reacting one mole of a precursor of one moiety with one mole of inorganic peroxide to form a peroxyacid and thereafter reacting the peroxyacid with one mole of a precursor of the other moiety, e.g. one mole of phthalic anhydride is reacted with one mole of hydrogen peroxide to form monoperoxyphthalic acid which is then reacted with one mole of acetic anhydride to form phthaloyl acetyl peroxide. As disclosed hereinbefore, where the diacyl peroxide contains a plurality of peroxidic groups, polymeric products can be formed. Thus, for example, reaction of pyromellitic anhydride with aqueous hydrogen peroxide produces a mixture containing isomers of diperoxycarboxydicarboxydibenzoyl peroxide and polymeric derivatives. The reaction between the precursor and the inorganic peroxide is usually carried out under alkaline conditions. Where only one peroxidic group is to be introduced, e.g. to form diphthaloyl peroxide, the reaction conveniently can be effected in aqueous conditions.

It is often desirable to employ reaction temperatures in the region of ambient or lower, such as 0° to 15° C. Reaction times obviously vary as the conditions vary, but in general from 10 to 100 minutes is sufficient. The diacyl peroxides can in general be precipitated from solution by acidifying. Especially preferred processes for producing diphthaloyl peroxide are described in British Patent Applications Nos. 20030/75 and 47388/75.

Having now described the present invention in general terms, specific embodiments will now be described more fully by way of example and compared with compositions outside the invention, the term "DPP" being used for diphthaloyl peroxide.

EXAMPLE 1

In this Example the rate of hydrolysis of DPP was compared with the rate of hydrolysis of similar peroxides. The experiment was conducted by dissolving the diacyl peroxide in deionised water to give a solution having an Av. Ox. content of 50 ppm. The solution was maintained at the pH indicated by the addition of 0.1 N sodium hydroxide solution and at a temperature of 40° ± 0.5° C. The solution of aliquots thereof were withdrawn, quenched by pouring into ice cold sulphuric acid and analysed for peroxy acid after the specified time interval. The results are summarised in Tables 1 and 2 hereinbelow, in which the figures given are mole percentage conversion of the diacyl peroxide to peroxy acid Experiments with dibenzoyl peroxide, bis-p-nitro benzoyl peroxide, bis-p-methoxy benzoyl peroxide and benzoyl glutaryl peroxide are present by way of comparison only.

TABLE 1

| Diacyl Peroxide | Peroxyacid present after 3½ minutes | 10 | 30 | 60 | 110 |
|---|---|---|---|---|---|
| Dibenzoyl peroxide | 0.2 | 0.5 | 2.4 | 5.4 | 10.3 |
| Bis-p-nitro benzoyl peroxide | 0.5 | 1.3 | 2.8 | 5.2 | 9.9 |
| Bis-p-methoxy benzoyl peroxide | 0.8 | 1.2 | 1.9 | 2.4 | 2.8 |
| DPP | 86 | 94 | 87 | 75 | 60 |

TABLE 2

| Diacyl Peroxide | Time minutes | Peroxyacid present at pH 10 | 9 | 8 | 6 | 2.5 |
|---|---|---|---|---|---|---|
| Benzoyl glutaryl peroxide | 5 | — | 59 | — | — | — |
| " " | 20 | 96 | 63 | 46 | — | — |
| DPP | 10 | 96 | 90 | 95 | 91 | 61 |

From Table 1 it can be seen that DPP hydrolysed considerably faster than any of the other symmetrical diacyl peroxides. Such other symmetrical peroxides are formed when asymmetrical peroxides like benzoyl glutaryl peroxide or benzoyl succinyl peroxide and the corresponding para-nitro or para-methoxy substituted peroxides are dissolved in aqueous washing solutions. Thus, more effective use is able to be made of the active oxygen content of the diacyl peroxide.

From Table 2 it can be seen that benzoyl glutaryl peroxide is extremely sensitive to variations in pH, so that, at pH's of 9 and below, at least a high proportion of the benzoyl moiety forms insoluble peroxide. In comparison, DPP is substantially insensitive to variations in pH within the usual range of from 8 to 10.

EXAMPLE 2

This Example demonstrates the effect on hydrolysis of diacyl peroxide in the presence of a perhydroxyl group. The experiment was conducted in the manner of Example 1 for diacyl peroxide with the difference being that an additional 50 ppm of active oxygen was provided by the addition of hydrogen peroxide. The results are summarised in Table 3 hereinbelow, in which the figures quoted are the mole percentage of peroxy-acid based on the diacyl peroxide present initially in solution after the times shown in Table 3. Experiments using dibenzoyl peroxide, bis-p-nitro benzoyl peroxide and bis-p-methoxy benzoyl peroxide are present by way of comparison only.

TABLE 3

| Diacyl peroxide | Peroxyacid present after 2.5 minutes | 5 | 10 | 30 | 60 | 120 |
|---|---|---|---|---|---|---|
| Dibenzoyl peroxide | 1.9 | 2.2 | 2.8 | 4.8 | 9.1 | 24.4 |
| Bis-p-nitro benzoyl peroxide | 0.3 | 0.5 | 1.2 | 28.6 | 48.0 | 76.4 |
| Bis-p-methoxy benzoyl peroxide | 0.9 | 1.0 | 1.6 | 2.2 | 2.6 | 3.6 |
| DPP | 182 | 198 | 198 | 198 | 185 | 171 |

From Table 3 it can be seen that DPP produced peroxyacid in solution considerably faster than any of the other diacyl peroxides, and also formed almost two moles of peroxyacid per mole of diphthaloyl peroxide, indicating that rapid reaction with hydrogen peroxide had occurred. This demonstrates that a significant proportion of bleaching agent active at low temperatures can be produced in situ from relatively inactive hydrogen peroxide. Similar results are obtained using a solid peroxo compound such as sodium perborate tetrahydrate instead of hydrogen peroxide.

EXAMPLE 3

In this Example swatches made of cotton or cotton/polyester (the latter being sold by Rhone Poulenc under the name TERGAL) were washed with detergent composition containing DPP or 1:1 mole ratio mixtures of DPP and sodium perborate tetrahydrate (PBS) or sodium percarbonate (PCS). The experiments were carried out in a laboratory scale washing machine, sold under the name Tergotometer and manufactured by U.S. Testing Corporation, which simulates the action of a vertical agitator type of domestic washing machine. In each experiment the stained fabrics were washed with one liter of solution containing 4 g of a base detergent composition consisting of sodium salt of linear alkyl benzene sulphonate 15%, sodium tripolyphosphate 37%, sodium silicate 6%, coconut monoethanolamide 3%, sodium carboxymethylcellulose 1.5%, water 6% and the balance of sodium sulphate, by weight, and sufficient active oxygen containing compound(s) to yield the Av. Ox. content in solution given in Table 4. In each experiment the solution was warmed to the temperature indicated of 40° or 50° or 60° C., the active oxygen containing compound or compounds were added and the pH brought to the indicated level by, if necessary, the addition of anhydrous sodium carbonate. Two swatches of fabric stained with stain and weighing 5 g each were placed in the solution and the temperature maintained constant. After 10 minutes one swatch was withdrawn, rinsed with cold water and dried, and after a further 20 minutes the second swatch was also withdrawn, rinsed and dried. The stain removal was determined by measuring the reflectance of the swatches before and after washing, using a Zeiss ELREPHO Reflectance Photometer using a Xenon lamp light source equipped with a y-tristimulus filter. Each swatch was measured four times with a backing of three thicknesses of material. The reflectance readings were averaged and the percentage stain removal was obtained from the following formula:

Percentage stain removal $= 100 \times (R_f - R_i)/(R_u - R_i)$ where $R_u$ means reflectance of the unstained cloth, $R_i$ means reflectance of the cloth after staining, $R_f$ means reflectance of the stained cloth after bleaching. Swatches of cotton stained with red wind were obtained from E.M.P.A., St. Gallen, Switzerland. Swatches of other stained fabrics were obtained by padding the appropriate fabric through an appropriate stain solution, partially drying the fabric with an infra red drier, and repeating the padding and drying cycle time twice more.

In Table 4 the stain was red wine on cotton. In Table 5 the soil removal was effected at pH 9 and a total bleach concentration of 35 ppm. Av. Ox. in a 30 minute wash. In Table 6 the stain was also red wine on cotton, and the soil removal was effected at pH 9 using PBS/DPP at a total bleach concentration of 50 ppm Av. Ox. The mixtures of DPP and PBS or PCS employed had a mole ratio of 1:1. The result and other process conditions of each experiment are summarised in the Tables 4, 5 and 6 hereinbelow.

TABLE 4

| Bleaching System | Temp. ° C. | Duration (mins) | pH | % soil removal at concentration of bleach (ppm) 20 | 35 | 50 |
|---|---|---|---|---|---|---|
| DPP | 40 | 10 | 9 | 51 | 55 | 63 |
| DPP | 40 | 30 | 10 | 47 | 63 | 69 |
| DPP and PCS | 40 | 10 | 10 | 26 | 35 | 37 |
| DPP and PCS | 40 | 30 | 9 | 60 | 66 | 69 |

TABLE 5

| Fabric | Stain | Temp ° C. | % Soil removal with Blank | DPP/PBS |
|---|---|---|---|---|
| Cotton | Red wine | 30 | 28 | 67 |
| " | " | 40 | 38 | 74 |
| " | " | 60 | 31 | 79 |
| Cotton/ Polyester | " | 30 | 23 | 45 |
| " | " | 40 | 36 | 60 |
| " | " | 60 | 32 | 60 |
| Cotton | Tea | 40 | 45 | 50 |
| " | " | 60 | 52 | 61 |
| Cotton/ Polyester | " | 30 | 7 | 32 |
| " | " | 40 | 9 | 35 |
| " | " | 60 | 2 | 20 |
| Cotton | Coffee | 30 | 51 | 63 |
| " | " | 40 | 58 | 71 |
| " | " | 60 | 65 | 72 |
| Cotton/ Polyester | " | 30 | 69 | 79 |
| " | " | 40 | 70 | 86 |

TABLE 5-continued

| Fabric | Stain | Temp ° C. | % Soil removal with Blank | DPP/PBS |
|---|---|---|---|---|
| " | " | 60 | 71 | 89 |
| Cotton | Cocoa | 40 | 16 | 35 |
| " | " | 60 | 25 | 34 |

TABLE 6

| Temp ° C. | % soil removal after 10 minutes | 30 minutes |
|---|---|---|
| 40 | 61.5 | 79.5 |
| 50 | 65.8 | 81.3 |
| 60 | 74.8 | 88.0 |

From Tables 4, 5 and 6 it can be seen that DPP was capable of removing a significant proportion of the stain at a concentration in the bleaching solution of as low as 20 ppm, and at temperatures as low as 30° C. and that comparable results could be obtained employing a mixture of DPP with sodium perborate tetrahydrate.

EXAMPLE 4

The effectiveness of peroxyacids containing more than one peroxyacid substituent in the benzene nucleus was compared with a conventional inorganic bleaching agent by washing stained fabrics with 1 liter of detergent solution described in Example 4 but adding sufficient active oxygen-containing compounds to yield only 10 ppm active oxygen in solution. The washing was carried out at a temperature in the range 30° to 60° C. and at a pH of 9. The active oxygen-containing compounds consist of (a) sodium perborate tetrahydrate, (included for comparison) (b) the diacyl peroxide mixtures produced by reaction between hydrogen peroxide and pyromellitic anhydride, and (c) a mixture of (a) and (b) in the ratio of approximately one molecule of (a) per acyl peroxide linkage i.e. (a) contributes about 30% of the active oxygen. The fabrics comprised cotton or polyester cotton mixtures, and the stains are conventional household stains. The stain removal was measured and broadly it was found that the order of stain removal was (b) (c) (a) in the temperature range of 30° to 60° C.

EXAMPLE 5

In this Example, the effect of intimately contacting DPP with a diluent is demonstrated. Particulate DPP having the composition shown in C1 in Table 7 was thoroughly mixed with particulate diluent to obtain the content indicated. The compositions also contained small amounts of mnoperoxyphthalic acid (MPPA). The impact sensitivity of the composition was then measured using the standard drop weight test described herein on page 12 line 23 to page 13 line 9. In the results, the higher the value in kg. cms for impact sensitivity, the less sensitive the composition.

Table 7

| Example/ Comparison | Diluent | Final Content DPP (weights %) | MPPA | Sensitivity $E_{50}$ (kg.cm) |
|---|---|---|---|---|
| Cl | — | 95 | 5 | < 20 |
| Ex. 1 | Phthalic acid | 40 | 2 | >500 |
| Ex. 2 | Lauric acid | 39 | 5 | >500 |
| Ex. 3 | Boric acid/di n-butyl phthalate | 60 | 4 | >500 |
| Ex. 4 | Di n-butyl phthalate/non- | 50 | 6 | >500 |

Table 7-continued

| Example/ Comparison | Diluent | Final Content DPP (weights %) | Final Content MPPA (weights %) | Sensitivity $E_{50}$ (kg.cm) |
|---|---|---|---|---|
| | ionic surfactant | | | |
| Ex. 5 | Magnesium sulphate | 40 | 1 | >500 |
| Ex. 6 | Sodium sulphate | 40 | 5 | 250 |
| Ex. 7 | Sodium tripolyphosphate | 45 | 3 | >500 |
| Ex. 8 | Monobutyl phthalate | 50 | 2 | >500 |

From Table 7 it can be seen that non-hazardous compositions can be obtained despite the fact that the peroxide before desensitisation had a median point of only 20 Kg-cm. Similar desensitisation is seen when the other diacyl peroxides, e.g. 2,2',5,5'-tetracarboxy-4,4'-diperoxycarboxydibenzoyl peroxide, or 2,2', 3,3'-tetracarboxy-4,4'-diperoxydibenzoyl peroxide are intimately contacted with the diluents instead of diphthaloyl peroxide.

EXAMPLE 6

In this Example, 80 g of a mixture of DPP (44.8% by wt) and magnesium sulphate were placed on a rotating inclined glass pan and sprayed with water, forming the granular mixture into balls. Large balls were broken up with a spatula. When balling was completed, the balls were dried by heating to 40°-50° C. with infra red radiation, in a stream of air. 37 g of the product had a particle size in the range −1.0 mm + 0.5 mm and a DPP content of 42.8% by weight.

EXAMPLE 7

In this Example, 40 g of the fraction in the range −1.0 mm +0.5 mm of the granulated product as per Example 6 were placed in a rotating inclined glass pan and heated by infra red radiation to 40°-50° C. Air was blown gently into the pan and the granulated product was sprayed with 80 $cm^3$ of a 5% solution of polyacrylic acid (mol wt. 230000) over a period of about four hours, the temperature being maintained at 40°-50° C. and the air flow contained for a further half an hour to dry the product. 18.4 g of the product had a particle size of −2.0 mm and a DPP content of 40.0% by weight.

EXAMPLE 8

In this Example, lauric acid (2.0 g) was heated until only just molten in a 25 ml beaker, and a mixture of DPP and lauric acid (4.0 g, DPP content 45.3% by weight) added, and stirred whilst molten. The temperature was approximately 50° C.

One drop of a non ionic surfactant (commercially available under the Trade Name TERGITOL A4THN) was added to water (100 mls) and the mixture heated to 50° C. The molten mixture of DPP and lauric acid was poured into the water; the whole was stirred vigo with a four blade propeller-type stirrer, and cooled rapidly using an ice bath. Granular lauric acid coated DPP was filtered off, washed with water and dried in vacuo over phosphorus pentoxide, yielding 5.1 g having a DPP content of 35% by weight.

EXAMPLE 9

In this Example, paraffin wax (congealing point 54.5° C., 4.0 g) was heated to 60° C. and a mixture of DPP and a magnesium sulphate (5.0 g, DPP content 44.8% by weight) was added. The resultant molten mixture was stirred, poured onto a polyethylene sheet, cooled and then crushed into small particles and sieved, particles of −4.0 mm being retained. The particles were placed in a rotating inclined pan granulator and heated by infra red radiation until the particles began to soften. Sodium aluminosilicate (0.3 g) commercially available under the Trade Name ALUSIL was added to the granulator. The granular product was sieved and the fraction having particle size of −4.0 mm to +2.0 mm (4.5 g) had a DPP content of 26% by weight.

EXAMPLE 10

In this Example the method of Example 9 was followed, except that the starting mixture was DPP/sodium sulphate having a DPP content of 49% by weight. The final DPP content was 33% by weight.

EXAMPLE 11

In this Example, the storage stability of DPP was tested, by thoroughly mixing sufficient of the product of each of Examples 7 to 10 with a detergent base composition to form a heavy duty detergent composition which on dissolution of 4 g/liter produces 35 ppm available oxygen. The detergent base composition was a conventional composition, and similar comparative results can be obtained using other bases containing anionic surfactants. A 50 g portion of each composition was then sealed in a wax laminated detergent box of dimensions 7 × 11.5 × 2 cm and stored in a chamber maintained at 28° C. and a relative humidity of 70% RH. Representative samples were withdrawn from the boxes at intervals and the available oxygen content determined by a standard iodine/thiosulphate test method and compared with the initial available oxygen content. The results, quoted in percentage form are summarised in Table 8. In each case the coated products differs from its corresponding uncoated product only in the presence of the coating.

Table 8

| Coated Product Produced in Example No. | % of DPP remaining: Coated Product | % of DPP remaining: Uncoated Product | Test Period (Days) |
|---|---|---|---|
| 7 | 93.8 | 71.4 | 11 |
| 8 | 79.9 | 9.5 | 32 |
| 9 | 85.8 | 75.1 | 12 |
| 10 | 75.0 | 42.0 | 33 |

From Table 8 it can be seen that the coated product showed significantly less loss of active oxygen than its comparable uncoated product.

We claim:

1. In a bleaching or detergent composition containing a surfactant, a builder salt and a bleaching agent, the improvement wherein said bleaching agent comprises a diacyl peroxide of the general formula ROOR' wherein R represents a phthaloyl radical and R' represents an acyl radical, said phthaloyl radical and said acyl radical being such that diacyl peroxides of the general formulas ROOR, ROOR', and R'OOR' are soluble in mildly alkaline aqueous conditions.

2. A composition according to claim 1 wherein R' represents a phthaloyl radical or a succinyl or glutaryl radical.

3. A composition according to claim 1 further containing a persalt in a mole ratio to the acyl peroxide linkage of from 1:5 to 2:1.

4. A composition according to claim 1 wherein the diacyl peroxide bears a coating to reduce destructive interaction during storage with other components of the detergent or bleaching composition.

5. A composition according to claim 1 further including sodium sulphate.

6. A composition according to claim 1 wherein said surfactant is present in an amount of from 1 to 90% by weight, said builder salt is present in an amount of from 1 to 90% by weight, and said bleaching agent is present in an amount such that the active oxygen content of the composition is from 1 to 4% by weight.

7. A composition according to claim 1 wherein R represents a phthaloyl radical such that there is generated in aqueous solution a peroxyacid of general formula:

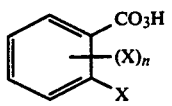

(2)

wherein X represents a carboxy or peroxycarboxy group and $n \geqq 0$, or anions thereof, the benzene nucleus in R optionally being substituted by a lower alkyl, nitro or chloro group.

8. A composition according to claim 7 wherein x represents a carboxy group and $n = 0$.

9. A composition according to claim 1 wherein R represents a phthaloyl radical such that there is generated in aqueous solution a peroxyacid of general formula:

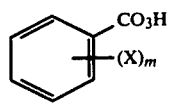

(1)

wherein X is as defined in claim 7 and m is 2 or 3.

10. A composition according to claim 9 wherein R is capable of generating mono- or triperoxy trimellitic acid, or diperoxypyromellitic acid.

11. A composition according to claim 1 wherein the diacyl peroxide is intimately contacted with a desensitising amount of a solid desensitising diluent.

12. A composition according to claim 11 wherein the solid desensitising diluent comprises a detergent builder salt.

13. A composition according to claim 11 wherein the diacyl peroxide is particulate and is granulated with the diluent.

14. A composition according to claim 11 wherein said desensitising diluent comprises a member selected from the group consisting of hydrocarbons having a melting point in excess of 30° C., aliphatic fatty and aromatic acids and esters thereof, boric acid and alkali or alkaline earth metal salts of halogen-free acids having a first dissociation constant of at least $1 \times 10^{-3}$.

15. A composition according to claim 14 wherein the diluent comprises lauric acid, phthalic acid, n-butyl esters thereof, sodium sulphate, magnesium sulphate or sodium tripolyphosphate.

16. A composition according to claim 1 wherein the diacyl peroxide is symmetrical.

17. A composition according to claim 16 wherein the diacyl peroxide comprises diphthaloyl peroxide.

18. In a composition suitable for mixing with a surfactant to form a detergent composition comprising a bleaching agent in intimate contact with a desensitizing amount of a detergent builder, the improvement wherein said bleaching agent comprises a diacyl peroxide of the general formula ROOR' wherein R represents a phthaloyl radical and R' represents an acyl radical, said phthaloyl radical and said acyl radical being such that diacyl peroxides of the general formulas ROOR, ROOR' and R'OOR' are soluble in mildly alkaline aqueous conditions.

* * * * *